US007794569B2

(12) United States Patent
Halmschlager et al.

(10) Patent No.: US 7,794,569 B2
(45) Date of Patent: Sep. 14, 2010

(54) SUPPORT BAND

(75) Inventors: Günter Halmschlager, Krems (AT); Herbert Boden, St. Pölten (AT); Christoph Haase, Asperhofen (AT)

(73) Assignee: Voith Patent GmbH, Heidenheim (DE)

( * ) Notice: Subject to any disclaimer, the term of this patent is extended or adjusted under 35 U.S.C. 154(b) by 460 days.

(21) Appl. No.: 11/773,605

(22) Filed: Jul. 5, 2007

(65) Prior Publication Data

US 2007/0272379 A1 Nov. 29, 2007

Related U.S. Application Data

(63) Continuation of application No. PCT/EP2005/056146, filed on Nov. 22, 2005.

(30) Foreign Application Priority Data

Jan. 5, 2005 (DE) ..... 10 2005 000 793

(51) Int. Cl.
*D21G 9/00* (2006.01)

(52) U.S. Cl. ..... 162/289; 162/358.1; 162/358.2; 162/202; 442/320; 156/900

(58) Field of Classification Search ..... 162/289, 162/100, 358.2, 202, 358.1; 442/320; 156/900, 156/901

See application file for complete search history.

(56) References Cited

U.S. PATENT DOCUMENTS

| | | | | |
|---|---|---|---|---|
| 4,483,745 | A * | 11/1984 | Wicks et al. | 162/205 |
| 5,972,813 | A | 10/1999 | Polat et al. | 442/320 |
| 6,189,233 | B1 | 2/2001 | Halmschlager et al. | 34/117 |
| 6,383,339 | B1 * | 5/2002 | Gstrein | 162/358.4 |
| 6,616,814 | B2 * | 9/2003 | Best | 162/358.4 |
| 6,962,885 | B1 * | 11/2005 | Best | 442/59 |

FOREIGN PATENT DOCUMENTS

| | | |
|---|---|---|
| DE | 29706427 | 4/1997 |
| DE | EP-1586701 | * 10/2005 |
| EP | 1069235 | 7/1999 |
| EP | 1586701 | 3/2005 |

* cited by examiner

*Primary Examiner*—Mark Halpern
(74) *Attorney, Agent, or Firm*—Taylor IP, PC

(57) ABSTRACT

A support band for a drying arrangement for drying one of a paper, a board, a tissue and a fibrous web in a papermaking machine for at least one of producing and finishing the same, the support band including a water-impermeable sealing layer and at least one water-absorbing storage layer. The at least one water-absorbing storage layer being adjacent to the water-impermeable sealing layer. At least one of the water-impermeable sealing layer or the water-absorbing storage layer being made, at least partially, of a highly thermally conductive material.

18 Claims, 2 Drawing Sheets

SUPPORT BAND

CROSS REFERENCE TO RELATED APPLICATIONS

This is a continuation of PCT application No. PCT/EP2005/056146, entitled "SUPPORT BAND", filed Nov. 22, 2005.

BACKGROUND OF THE INVENTION

1. Field of the Invention

The invention relates to a support band and the use of a support band for a drying arrangement for drying one of a paper, a board, a tissue or an other fibrous web in a machine for one of producing and finishing the same.

2. Description of the Related Art

In drying arrangements the steam arising as a result of the heating of the fibrous web during the contact with the heated drying cylinder passes into water-absorbing bands surrounding the fibrous web as it wraps around the drying cylinder. In these bands, condensation and storage of the condensate occur. Following the wrapping, the bands are led away from the fibrous web, cleaned and dried again.

On the bands, a sealing band wraps around the drying cylinder and prevents steam from escaping. This sealing band is normally cooled, so as to intensify the temperature gradient toward the heated drying cylinder, to predefine the direction of the evaporation from the fibrous web and to intensify the condensation of the steam.

Drying arrangements of this type are relatively complicated and expensive, in particular because of the large number of bands and their guidance.

What is needed in the art is a simplified drying arrangement that reduces the expenditure for the bands.

SUMMARY OF THE INVENTION

According to one embodiment of the present invention, the support band has a water-impermeable sealing layer and at least one water-absorbing storage layer. At least the sealing layer includes, at least partly, a highly thermally conductive material.

Since the support band not only acts in a sealing manner, but is also able to absorb the steam escaping from the fibrous web as a result of the heating and the condensate forming, the number of necessary bands is reduced. This also leads to a simplification of the structure.

The highly thermally conductive material of the sealing layer permits the formation of a relatively large temperature gradient between the heated drying cylinder and the sealing layer. This applies in particular if the sealing layer of the support band, located on the outside as it wraps around the drying cylinder, is cooled. This temperature gradient predefines the evaporation direction from the fibrous web, the cooling promoting the condensation of the steam in the storage layer. This is further assisted by the fact that the storage layer also consists, at least partially, of a highly thermally conductive material.

A further accomplishment is achieved if the sealing layer and/or the storage layer consists completely of a highly thermally conductive material, preferably metal.

In order, on the one hand, to ensure the stability of a metal band, in particular on account of the tensile forces occurring during the wrapping, but on the other hand, also to permit adequate flexibility of the metal band, the thickness of the metal band should preferably be between 0.05 and 2 mm.

The metal band can overall form the sealing layer. However, it may also be advantageous if the metal band has a profiled surface on one side, which forms at least part of the storage layer, and the sealing layer is formed by the other part of the metal band. The profiling of the metal band can be implemented by way of spark erosion, compression molding or laser removal. This embodiment of the support band is very simple in construction.

However, the support band can advantageously also include a metal fabric, which forms the sealing layer and at least part of the storage layer. To this end, the part provided for the sealing layer can be fused, in a sealing manner, on one side of the metal fabric. However, it may also be advantageous to fill the metal fabric with a filling material of plastic or metal in order to form a sealing layer on the appropriate side. In both cases, the porous region of the metal fabric should form at least part of the storage layer. This combining of functions contributes substantially to the simplification.

If the storage layer of the metal band or metal fabric does not have sufficient storage capacity, then, on the side facing away from the sealing layer, the metal band or the metal fabric is joined to at least one water-absorbing storage band, in at least some zones, in order to form or expand the storage layer. In order to avoid indentations on the fibrous web, the outer storage band should be as smooth and fine as possible on the side facing the fibrous web.

Depending on the loading and the requirement on the thermal conductivity, the storage band should be formed by a fabric made of metal and/or plastic. A connection between the metal band or the metal fabric and the adjacent storage band and, if appropriate, also between the storage bands, can be accomplished by adhesive bonding, welding, riveting, soldering or the like.

In order to reduce the effort needed for this purpose, it is sufficient if the corresponding storage band is connected to the metal band or the metal fabric only in the edge regions. This applies in particular because of the increased loading by the drive in the edge regions. For this reason, it may also be advantageous if the metal fabric or the metal band has a higher strength in the edge regions. The higher strength may be accomplished in many ways including, but not limited to the use of higher strength materials in the edge regions, the use of more material in the edge regions, or the use of a different mix of materials in the edge regions.

On the side facing away from the storage layer, the support band should be smooth. This makes it easier to seal with respect to a cooling unit for cooling the sealing layer with blown air or water. In addition, the thickness of the support band should lie between 0.6 and 7 mm in order to ensure adequate flexibility and an adequate storage volume for the steam and the condensate. The thickness of the support band should preferably be less than 5 mm, in particular less than 3 mm.

For the application of the support band in drying arrangements for fibrous webs, it is sufficient if the storage volume of the support band lies between 200 and 3000 $cm^3/m^2$.

In order to take care of the joint between the metal band or metal fabric and the adjacent support band as a consequence of alternating bending loading, the neutral fiber of the support band should deviate by at most 50% of the thickness of the metal band or metal fabric from the connecting region between the metal fabric or metal band and the adjacent storage band. In order to minimize the bending loading, it is additionally advantageous if, outside the wrap region of the drying cylinder, the support band is led over guide rolls whose diameter is greater than 200 times, preferably greater than 500 times and in particular greater than 800 times the thickness of the support band.

If the storage volume of the support band should not be sufficient and/or the surface of the support band leads to markings, then it is advantageous if the drying cylinder is wrapped around by at least one further porous band, which is arranged between the fibrous web and the support band.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
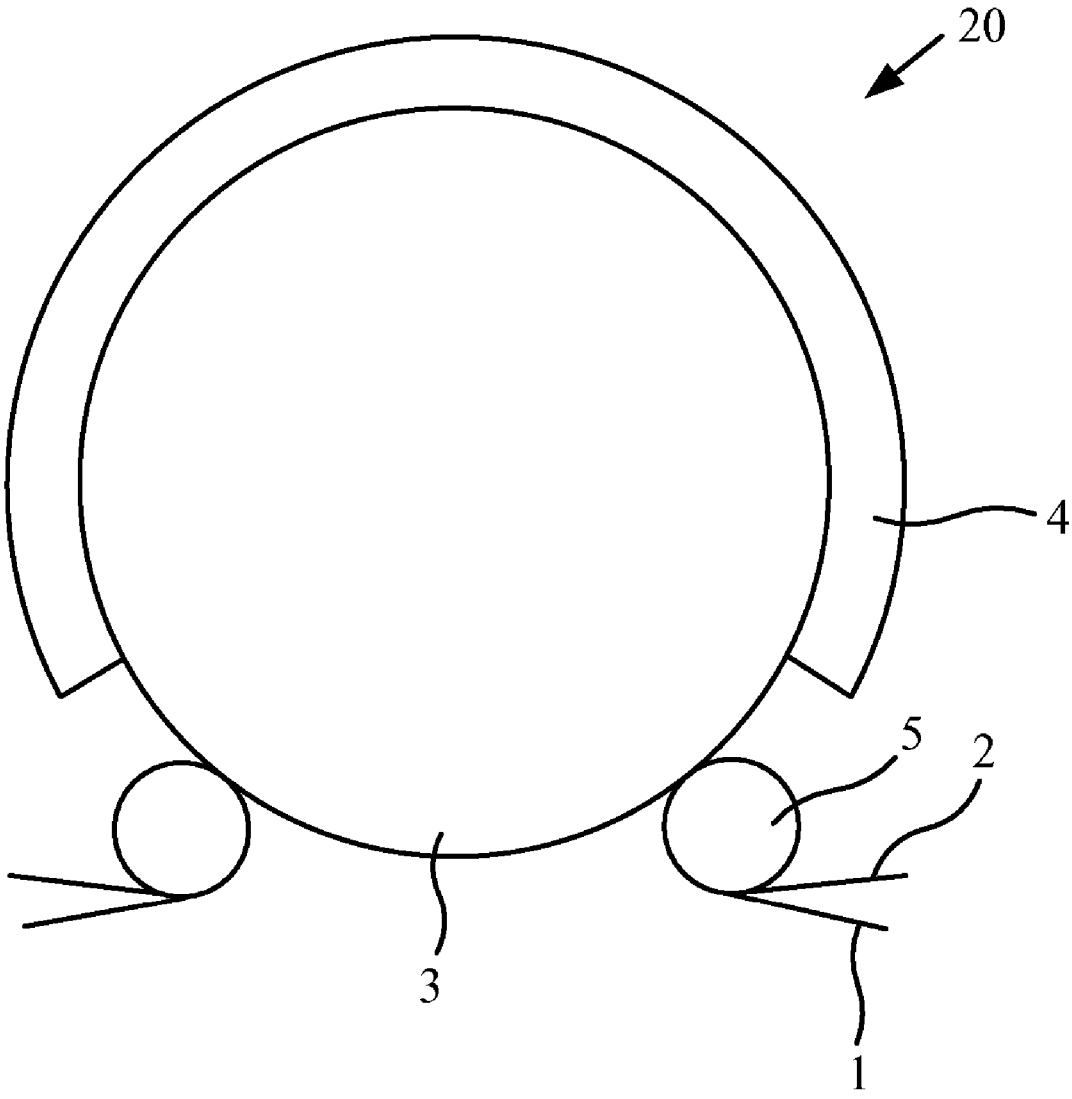
FIG. 1 shows a cross section view through a drying arrangement using an embodiment of a support band of the present invention.

Referring now to the drawings, and more particularly to FIG. 1, there is shown a drying arrangement 20 for the purpose of drying, a fibrous web 1 that wraps around a heated drying cylinder 3 together with a support band 2 located on the outside.

Figure 2:
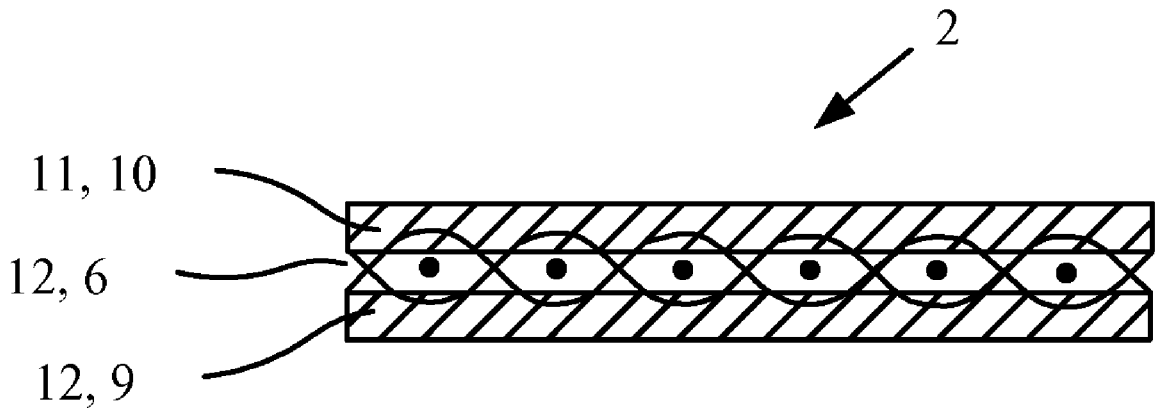
FIG. 2 shows a cross section view through one embodiment of the support band used in FIG. 1.
Figure 3:
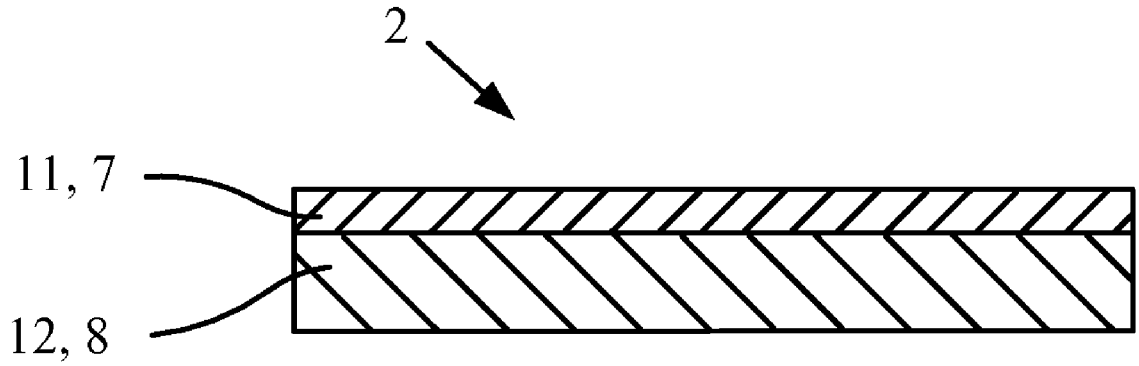
FIG. 3 shows a cross section view through another embodiment of the support band used in FIG. 1.

Now, additionally referring to FIGS. 2 and 3, support band 2 includes a watertight sealing layer 11 and a porous and water-absorbing storage layer 12 facing fibrous web 1.

As a result of the contact of fibrous web 1 with the hot circumferential surface of drying cylinder 3, evaporation into porous storage layer 12 of the support band 2 occurs, where the formation of condensate also occurs.

The thermal conductivity of sealing layer 11 is relatively high, since it is made, at least partly, of metal. This is necessary since sealing layer 11 is cooled in the wrap region of drying cylinder 3 originating from a hood 4 with the aid of water.

The temperature gradient between sealing layer 11 and drying cylinder 3, produced by the cooling, assists the condensation considerably. It is also advantageous if the thermal transfer coefficient a on both sides of sealing layer 11 is as high as possible.

The steam and the condensate are picked up by storage layer 12 and can be removed again after support band 2 has been led away from fibrous web 1. It is therefore also advantageous if the open structure of storage layer 12 has a dirt-repellent surface, which may be made of a PTFE coating. Cleaning can be carried out by blowing out, throwing out or sucking out.

In order to be able to seal sealing layer 11 as well as possible with respect to hood 4, the outer surface of sealing layer 11 should be as smooth as possible.

The thickness of support band 2 lies between 1.5 and 4 mm, sealing layer 11 having less than 40% of the thickness of support band 2.

In order to configure the drying arrangement together with band guidance as simply as possible, support band 2 includes sealing layer 11 and storage layer 12. This also reduces the expenditure for the bands of the drying arrangement overall.

According to FIG. 2, support band 2 includes a metal fabric 6 which, in order to form a sealing layer 11, is filled on one side with a filling material 10 made of plastic. The remaining porous region of support band 2 partly forms storage layer 12.

Since the contact area of storage layer 12 with fibrous web 1 should be as smooth and fine as possible in order to avoid markings, a further fabric layer 9, which is woven with metal fabric 6, adjoins metal fabric 6 on the side opposite of sealing layer 11.

Another embodiment of a support band 2 of the present invention is illustrated in FIG. 3. Here, sealing layer 11 is formed by a metal band 7 which has a thickness of between 0.2 and 0.5 mm. Storage layer 12 is formed as a porous storage band 8 which is adhesively bonded to metal band 7.

Outside the wrap region of drying cylinder 3, support band 2 is led over guide rolls 5, whose diameter is greater than 800 times the thickness of support band 2, in order to minimize the bending loading of support band 2.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support band for a drying arrangement for drying a fibrous web in a papermaking machine for at least one of producing and finishing the fibrous web, the support band comprising:

a water-impermeable sealing layer; and at least one water-absorbing storage layer adjacent said water-impermeable sealing layer, at least one of said water-impermeable sealing layer and said water-absorbing storage layer being made at least partially of a highly thermally conductive material, said highly thermally conductive material being a metal fabric, said metal fabric being both a part of said water-impermeable sealing layer and a part of said water-absorbing storage layer.

2. The support band of claim 1, wherein both said water-impermeable sealing layer and said water-absorbing storage layer are made at least partially of said highly thermally conductive material.

3. The support band of claim 1, wherein said water-impermeable sealing layer includes a metal band having a thickness of between 0.05 and 2 mm.

4. The support band of claim 3, wherein said metal band has a profiled surface on one side which forms at least part of said water-absorbing storage layer.

5. The support band of claim 1, wherein said metal fabric is fused in a sealing manner on one side to thereby form said water-impermeable sealing layer.

6. The support band of claim 1, wherein said metal fabric is filled with a filling material to form said water-impermeable sealing layer, said filling material being one of a plastic material and a metal material.

7. The support band of claim 1, wherein said metal fabric includes a porous region, said porous region being at least a part of said water-absorbing storage layer.

8. The support band of claim 1, wherein said metal fabric has a side facing away from said water-impermeable sealing layer, said side being joined to at least one water-absorbing storage band in at least some zones thereby at least one of forming and expanding said water-absorbing storage layer.

9. The support band of claim 8, wherein said water-absorbing storage layer is formed from a fabric made of at least one of metal and plastic.

10. The support band of claim 8, wherein said water-absorbing storage layer is connected to said metal fabric only along regions proximate to the edges of the support band.

11. The support band of claim 10, wherein said metal fabric has a first strength in said regions and a second strength apart from said regions, said first strength being higher than said second strength.

12. The support band of claim 8, wherein the support band has a side facing away from said water-absorbing storage layer that is smooth.

13. The support band of claim 1, wherein the support band has a thickness of between 0.6 mm and 7 mm.

14. The support band of claim 13, wherein said thickness is between 0.6 mm and 5 mm.

15. The support band of claim 14, wherein said thickness is between 0.6 mm and 3 mm.

16. The support band of claim 1, wherein the support band has a storage volume of between 200 $cm^3/m^2$ and 3,000 $cm^3/m^2$.

17. A support band for a drying arrangement for drying a fibrous web in a papermaking machine for at least one of producing and finishing the fibrous web, the support band comprising:

one of a metal band and a metal fabric;

at least one storage band adjacent one of said metal band and said metal fabric; and neutral fiber positioned in a connecting region of said at least one storage band and one of said metal band and said metal fabric, said neutral fiber deviating by at most 50% of a thickness of one of said metal band and said metal fabric.

18. A support band for a drying arrangement for drying a fibrous web in a papermaking machine for at least one of producing and finishing the fibrous web, the support band comprising:

a water-impermeable sealing layer; and at least one water-absorbing storage layer adjacent said water-impermeable sealing layer, at least one of said water-impermeable sealing layer and said water-absorbing storage layer being made at least partially of a highly thermally conductive material, said highly thermally conductive material being a metal band having a profiled surface on one side thereof, said profiled surface forming at least a part of said water-absorbing storage layer, said metal band having another side that is at least a part of said water-impermeable sealing layer.

* * * * *

UNITED STATES PATENT AND TRADEMARK OFFICE

CERTIFICATE OF CORRECTION

PATENT NO. : 7,794,569 B2
APPLICATION NO. : 11/773605
DATED : September 14, 2010
INVENTOR(S) : Günter Halmschlager et al.

It is certified that error appears in the above-identified patent and that said Letters Patent is hereby corrected as shown below:

COLUMN 3

At line 53, please delete "coefficient a", and substitute therefore --coefficient α--.

Signed and Sealed this
Fourth Day of October, 2011

David J. Kappos

David J. Kappos
*Director of the United States Patent and Trademark Office*